United States Patent [19]

Coldren et al.

[11] Patent Number: 4,601,530

[45] Date of Patent: Jul. 22, 1986

[54] ELECTRICAL CONNECTOR AND WIRE ASSEMBLY METHOD

[75] Inventors: Daniel R. Coldren, Enola; Wayne S. Davis, Harrisburg; Jon A. Fortuna, New Cumberland, all of Pa.

[73] Assignee: AMP Incorporated, Harrisburg, Pa.

[21] Appl. No.: 769,992

[22] Filed: Aug. 23, 1985

Related U.S. Application Data

[63] Continuation of Ser. No. 645,946, Aug. 30, 1984, abandoned.

[51] Int. Cl.[4] ..... H01R 13/00

[52] U.S. Cl. ..... 339/103 M

[58] Field of Search ..... 339/103 R, 103 M, 206 R, 339/206 P, 207, 209, 210 R, 210 M

[56] References Cited

U.S. PATENT DOCUMENTS

| | | | |
|---|---|---|---|
| 3,402,382 | 9/1968 | DeTar | 339/103 M |
| 4,514,027 | 4/1985 | Seidel | 339/105 |

FOREIGN PATENT DOCUMENTS

| | | | |
|---|---|---|---|
| 2523915 | 12/1976 | Fed. Rep. of Germany . | |
| 975405 | 3/1951 | France | 12/6 |
| 2236290 | 1/1975 | France . | |

*Primary Examiner*—Joseph H. McGlynn

*Attorney, Agent, or Firm*—Robert W. J. Usher

[57] ABSTRACT

Discrete wires are unraveled from a bundle of wires and assembled in respective passageways (12) in an electrical connector housing (11) by preloading the wires into a wire holder (21) which locates the leading ends of the wires at the same pitch as the passageways (12) but in staggered relation. The wire holder (21), supported by the wires, is then inserted into and along a mouth (14) of the housing (11) until it abuts a tapering throat (13) at the entrance to the passageways (12). Further advance of the bundle feeds the discrete wires through the wire holder (21) into the respective passageways (12) guided by the throat (13).

19 Claims, 11 Drawing Figures

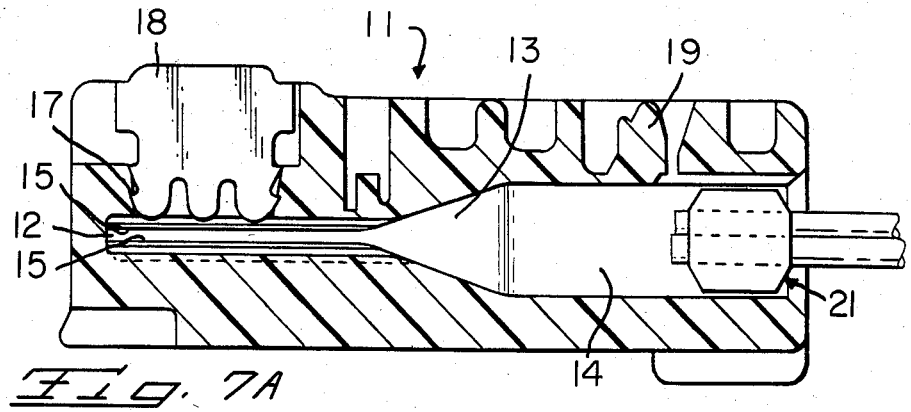
Fig. 7A
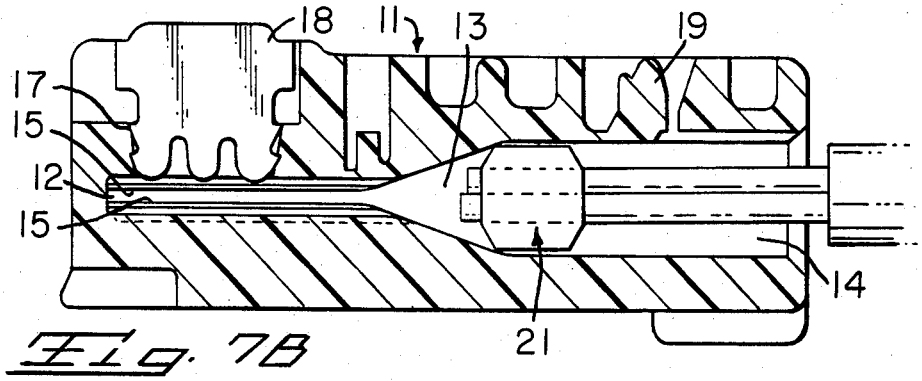
Fig. 7B
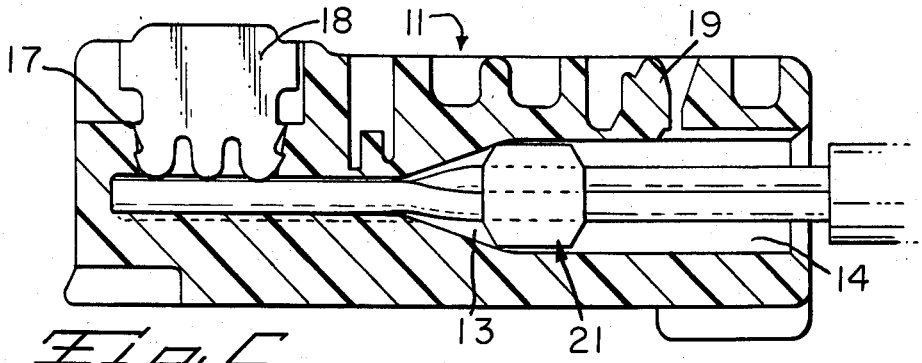
Fig. C
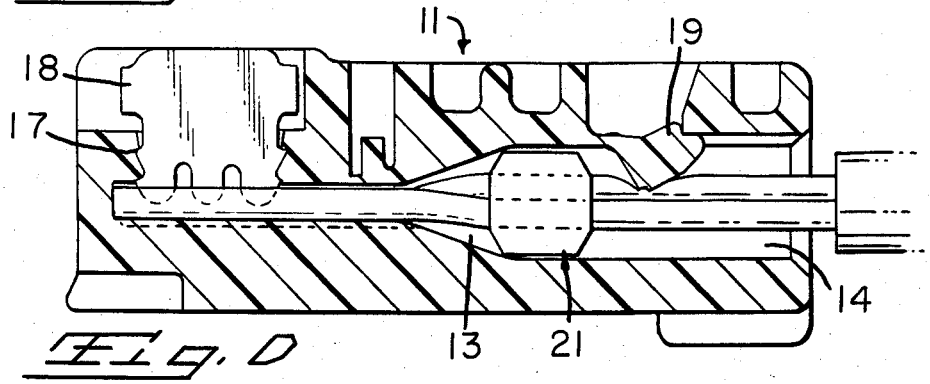
Fig. D

ELECTRICAL CONNECTOR AND WIRE ASSEMBLY METHOD

This application is a continuation of application Ser. No. 645,946 filed Aug. 30, 1984 abandoned.

The invention relates to an electrical connector and to a method of assembling discrete wires of a series of discrete wires in an electrical connector housing.

A known type of connector housing is formed with a series of wire receiving passageways arranged in closely spaced relation in a single row, such passageways communicating through a divergent, wire guiding throat with a common wire receiving mouth of increased size. Flat cable, in which a series of wire-like conductors are located in side-by-side relation at the same pitch as the passageways by webs of insulation, may readily be assembled in the housing for termination, by insertion of a free end into and along the mouth so that the conductors are guided into respective passageways by the throat. The cavities intercommunicate through lateral openings to admit the web of the flat cable between them. Terminals that have been preloaded into the housing in alignment with respective passageways are then driven into engagement with respective conductors and a rear portion of the housing adjacent the mouth crimped into engagement with the cable to provide strain relief. An example of such connector is described in U.S. patent application Ser. No. 423,486.

However, a problem arises, particularly in the field, when it is desired to assemble and terminate discrete wires extending from a bundle of wires in the housing.

The discrete wires cannot readily be maintained in the desired serial positions and at the correct pitch during insertion into the connector when unraveled from the bundle. In consequence, the free ends of the wires tend to butt against the lateral side walls of the passageways with the result that assembly is extremely difficult and time consuming.

According to one aspect of the invention there is provided a method of assembling discrete wires of a series of wires into preselected individual passageways of a series of passageways arranged in a connector housing in closely spaced relation in a single row, such passageways receiving the wires in a sliding fit and communicating through a divergent, wire guiding throat with a common wire receiving mouth of increased size, the method comprising the steps of loading discrete wires adjacent their free ends as a sliding fit in respective wire locating apertures of a series of apertures in a wire holder to form a subassembly, the wire holder being receivable as a sliding fit in the mouth and the apertures being at the same pitch as the passageways; inserting the subassembly, wire holder first, into and along the mouth initially to bring the wire holder into abutment with the throat and subsequently to advance the free ends of the discrete wires to project out of the wire holder guided into respective passageways by the throat.

The discrete wires can be terminated in respective passageways as before and a rear portion of the housing crimped or otherwise deformed into gripping engagement with the wire behind the wire holder to provide strain relief and retaining the wire holder in the mouth.

The wire holder assists in maintaining the discrete wires in the desired serial position and correct pitch as they pass into the throat so that even relatively badly twisted wires can readily be accurately located in their respective passageways when loaded into the wire holder simply by manually pushing the cable.

Desirably, the apertures are in staggered relation with adjacent apertures being located in different rows. This both enables the discrete wires to be maintained at the same close pitch as the passageways and the apertures to be defined by adjacent wall portions in spite of the close pitch.

Advantageously, the wires are loaded into the wire holder at locations spaced from their free ends, the free ends trimmed to lengths corresponding to axial lengths of the passageways and throat, and the wire holder then slid along the wires to the free ends.

This ensures that the wires are trimmed to the correct length so that they all extend sufficiently along the cavities for effective termination in the final axial position of the wire holder relative to the cable.

The apertures may open to only one or both sides of the wire holder providing comb-like structures which facilitate entry of the wires in the holder. Preferably, the slots have resilient wire entry portions of reduced width securely to retain the wires in the apertures throughout the loading step.

According to another aspect of the invention, there is provided a method of assembling discrete wires of a series of wires into preselected individual passageways of a series of passageways arranged in a connector housing in closely spaced relation in a single row and communicating through a divergent wire guiding throat with a common wire receiving mouth of increased size, such passagewys receiving the respective wires in a sliding fit, the method comprising the steps of loading discrete wires at locations spaced from their free ends by a distance corresponding to axial lengths of the passageways and throat in respective wire locating apertures of a series of apertures in a wire holder to form a subassembly, the wire holder being receivable as a sliding fit in the mouth and the apertures being at the same pitch as the passageways with adjacent apertures in different rows having centrelines on respective opposite sides of the centreline of the row of passageways; and inserting the subassembly into and along the mouth so that the free ends of the discrete wires are maintained at the same pitch as during their advance into respective passageways guided by the throat.

According to a further aspect of the invention, an electrical connector comprises a housing having a series of individual passageways arranged at a close pitch in a single row for receiving respective discrete wires in a sliding fit, the passageways communicating through a divergent, wire guiding throat with a common mouth of increased size open at a rear, a series of discrete wires extending from a bundle of wires having leading free ends received in a sliding fit in respective passageways and trailing portions in the mouth adjacent the throat loaded in wire locating apertures in a wire holder received in a sliding fit in the mouth, the wire locating apertures being at the same pitch as respective passageways but staggered with adjacent apertures in different rows, the leading ends of the wires being terminated by terminals entering the respective passageways.

An example of the invention will now be described with reference to the accompanying drawings in which.

Figure 1:
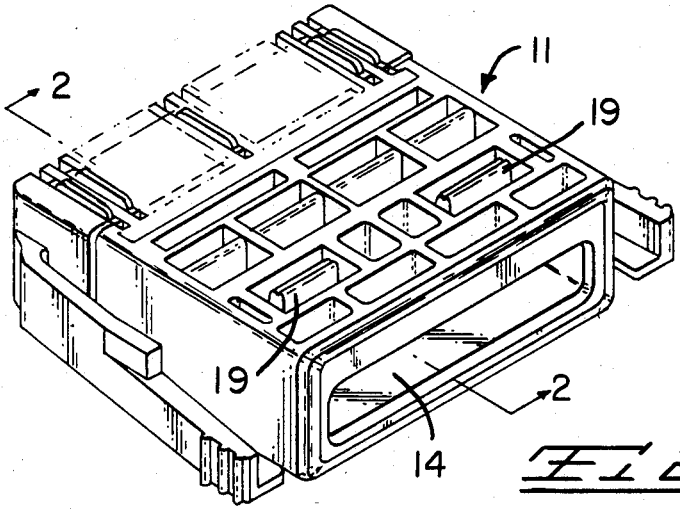
FIG. 1 is an isometric view of a known electrical connector in which wires can be terminated according to the method of the invention.
Figure 2:
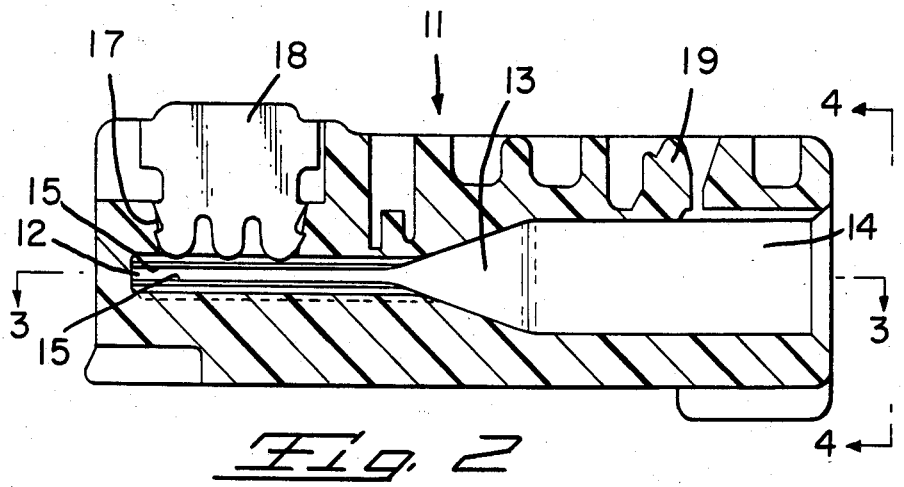
FIG. 2 is a cross-sectional view of the connector of FIG. 1.
Figure 3:
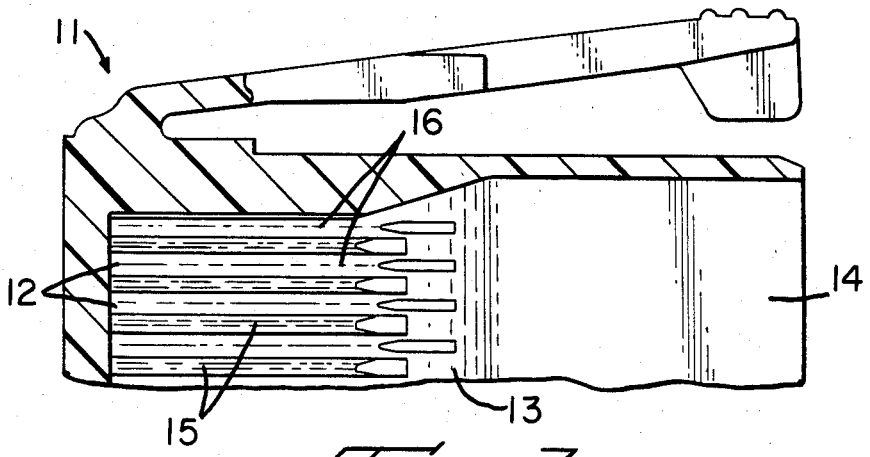
FIG. 3 is a cross-sectional view along line 3—3 of FIG. 2.
Figure 4:
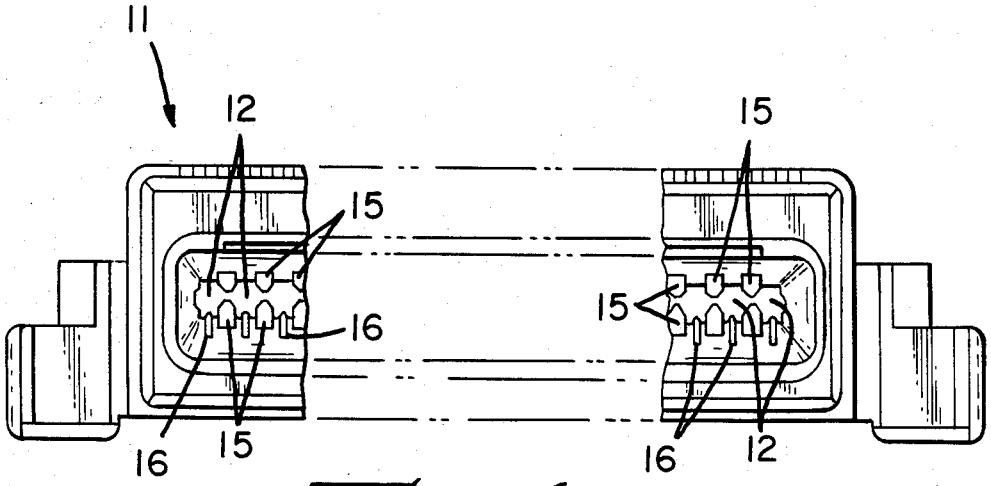
FIG. 4 is a rear view of the connector.
Figure 5:
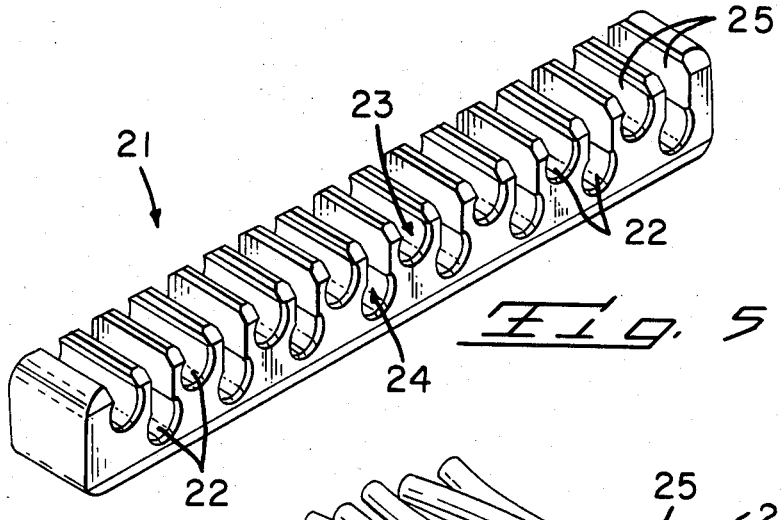
FIG. 5 is an isometric view of a wire holder according to the invention.
Figure 6A:
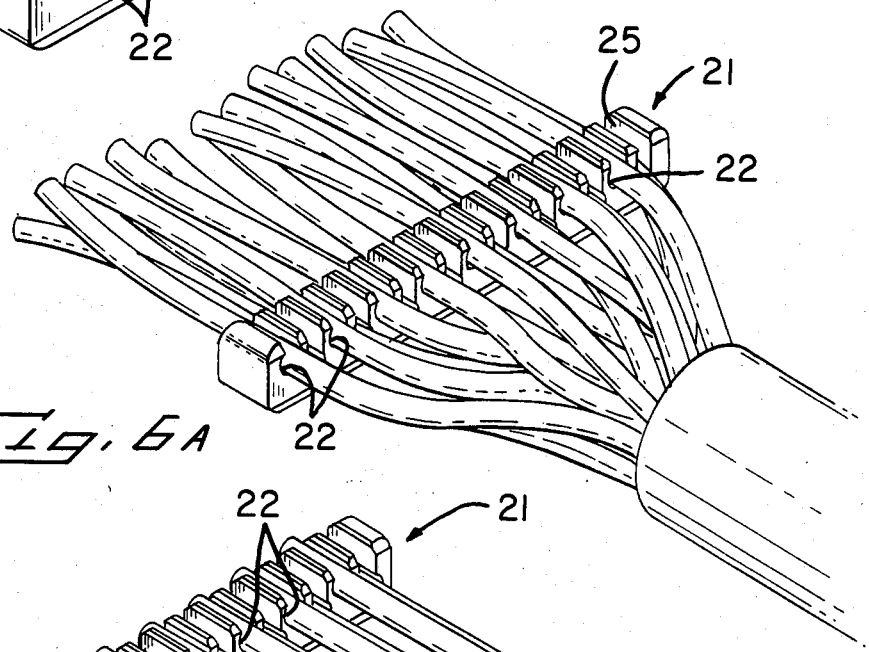
Figure 6B:
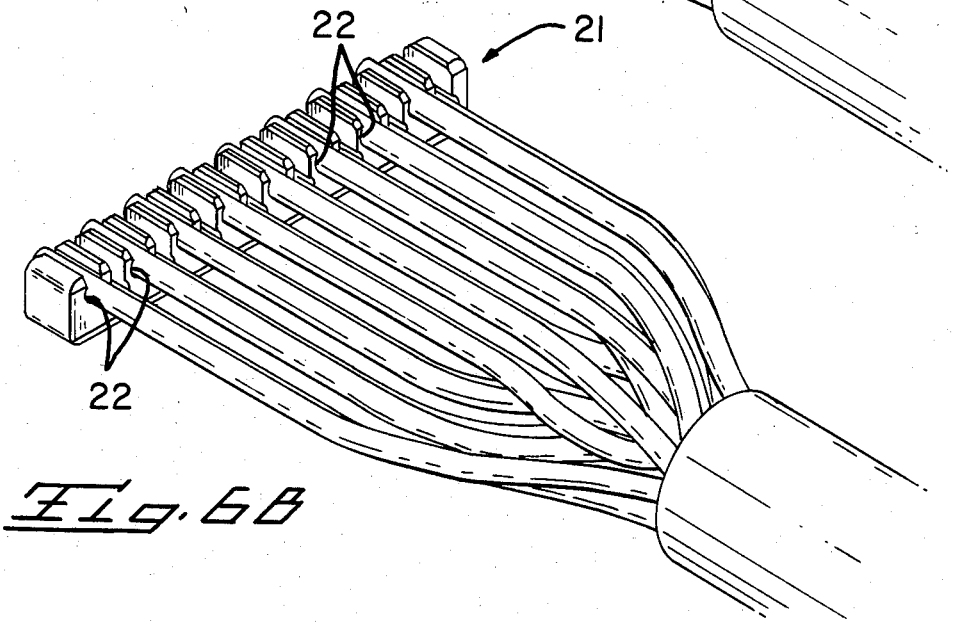

FIGS. 6*a* and 6*b* are isometric views of first and second steps of loading discrete wires into the wire holder; and FIGS. 7*a* through 7*d* are isometric views showing successive steps of loading a subassembly of the wire holder and wires into the connector and termination of the wires.

As shown particularly in FIGS. 1 through 4, a connector suitable for use in the invention is similar to that used for ribbon cable and disclosed in U.S. patent application Ser. No. 423,486, the disclosure of which is incorporated herein by reference. Briefly described, the connector comprises a housing 11 moulded in one piece of suitable plastics material formed with a single row of blind ended wire receiving passageways 12 extending rearwardly from a location adjacent a contact face and communicating through a common, divergent, wire guiding throat 13 with a wire receiving mouth 14 of increased size. Lateral walls 15 between adjacent passageways 12 are perforate (for receipt of the insulating web extending between conductors when used with the ribbon cable) passageways and conductor supporting rails 16 extend along the floor of each passageway. Contact receiving cavities 17 at the contact face communicate with the passageways and insulation piercing contacts 18 are preloaded in the cavities for termination with the respective conductors in the passageways. Deformable cable clamping latches 19 are formed in a wall of the mouth for deformation into the mouth into clamping engagement with a cable terminated in the connector.

A wire holder 21 is moulded in one piece of plastics material with a series of staggered wire locating apertures 22 located at the same pitch as the passageways 12 but in two rows 23 and 24, having centrelines on opposite sides of the centreline of the passageways, adjacent apertures being in different rows. The apertures open to a common side of the wire holder providing a resilient comb-like structure, walls of the apertures constituting teeth. Wire entry portions 25 of each aperture are of reduced width securely to retain wires in the holder. The overall size of the wire holder is such that it is receivable as a sliding fit in the mouth 14.

In order to assemble ends of discrete wires of a bundle of wires in a shielded cable, the outer insulating jacket is stripped adjacent the end to expose the foil shield which is returned over the jacket. The discrete wires are then unraveled and drawn laterally into the holder in their desired serial position with the holder spaced from the leading edges as shown in FIG. 6A. The ends of the discrete wires are then trimmed so that their leading edges are of lengths corresponding to the axial lengths of the passageway plus the axial length of the throat. The wire holder is then slid along the wires to a location adjacent their leading ends thereby holding the leading ends in a fixed position (FIG. 6B). The subassembly is then inserted into the mouth (FIG. 7A) and advanced by pushing the cable until the wire holder abuts the throat (FIG. 7B) when the discrete wires will be advanced through the wire holder guided by the throat into respective passageways as shown in FIG. 7C. The contacts 18 are then driven against the wires in known manner and the clamping portion deformed into engagement with the wires behind the wire holder to assist in providing strain relief (FIG. 7D).

It will be appreciated that the location of the centrelines of the rows of apertures 23, 24 equidistant from the centreline of the passageway permits the leading ends of the wires to be guided by the throat into the passageways with minimum deviation.

The resiliency of the aperture walls or teeth of the comb-like wire holder adjacent the wire entry ends of the wire holder apertures enables the wires to be loaded therein one-by-one and securely retained therein while remaining wires are manipulated into a desired position.

What is claimed is:

1. A method of assembling discrete wires of a series of wires into preselected individual passageways of a series of passageways arranged in a connector housing in closely spaced relation in a single row, such passageways receiving the wires in a sliding fit and communicating through a divergent, wire guiding throat with a common wire receiving mouth of increased size, the method comprising the steps of:

loading discrete wires adjacent their free ends as a sliding fit in respective wire locating apertures of a series of apertures in a wire holder to form a subassembly, the wire holder being receivable as a sliding fit in the mouth and the apertures being at the same pitch as the passageways, inserting the subassembly, wire holder first, into and along the mouth initially to bring the wire holder into abutment with the throat and subsequently to advance the free ends of the discrete wires to project out of the wire holder guided into respective passageways by the throat.

2. A method according to claim 1 in which the wires are loaded into the wire holder at locations spaced from their free ends, the free ends trimmed to lengths corresponding to axial lengths of the passageways and throat, and the wire holder then slid along the wires to the free ends.

3. A method according to claim 1 in which the apertures are in staggered relation with adjacent apertures being in different rows.

4. A method according to claim 3 in which centrelines of the rows of apertures are arranged on opposite sides of the centreline of the row of passageways.

5. A method according to claim 3 in which the apertures comprise wire slots opening to a side of the wire holder providing a comb-like structure.

6. A method of assembling discrete wires of a series of wires into preselected individual passageways of a series of passageways arranged in a connector housing in closely spaced relation in a single row and communicating through a divergent wire guiding throat with a common wire receiving mouth of increased size, such passageways receiving the respective wires in a sliding fit, the method comprising the steps of:

loading discrete wires at locations spaced from their free ends by a distance corresponding to axial lengths of the passageways and throat in respective wire locating apertures of a series of apertures in a wire holder to form a subassembly, the wire holder being receivable as a sliding fit in the mouth and the apertures being at the same pitch as the passageways but adjacent apertures being in different rows having centrelines on respective opposite sides of the centreline of the row of passageways, and inserting the subassembly into and along the mouth so that the free ends of the discrete wires are maintained at the same pitch as during their advance into respective passageways guided by the throat.

7. An electrical connector comprising a housing having a series of individual passageways arranged at a close pitch in a single row for receiving respective discrete wires in a sliding fit and communicating through a divergent wire guiding throat with a common mouth of increased size open at a rear, a series of discrete wires extending from a bundle of wires having leading free ends received in a sliding fit in respective passageways and trailing portions in the mouth adjacent the throat loaded in wire locating apertures in a wire holder received in a sliding fit in the mouth, the wire locating apertures being at the same pitch as respective passageways but staggered with adjacent apertures in different rows, the leading ends of the wires being terminated by terminals entering the respective passageways.

8. An electrical connector according to claim 7 in which the wires are received as a sliding fit in the apertures in the wire holder.

9. An electrical connector according to claim 7 in which the rows of apertures are arranged on opposite sides of, and equidistant from, the centreline of the row of passageways.

10. An electrical connector according to claim 7 in which the apertures comprise slots opening to a side of the wire holder to provide a comb-like structure.

11. An electrical connector according to claim 9 in which the slots have resilient wire entry portions of reduced width.

12. An electrical connector comprising an insulating housing having a wire receiving duct extending rewardly from a location adjacent a contact face and opening at a wire receiving mouth at a rear face; a row of closely spaced contact receiving cavities at the contact face communicating with the wire receiving duct at the location; a wire holder having a row of wire locating apertures at the same pitch as the cavities; a series of discrete wires extending from a bundle of wires loaded in the respective wire locating apertures of the wire holder so that the discrete wires are located in a row at the same pitch as the cavities; the wire holder loaded with the wires being inserted in the duct so that the discrete wires are aligned with respective cavities and a row of contacts received in respective cavities in terminating engagement with respective wires.

13. An electrical connector according to claim 12 in which the housing comprises a clamping portion deformed into engagement with the wires at a location between the rear face and the wire holder.

14. An electrical connector according to claim 13 in which the apertures open to a side of the wire holder towards the contacts.

15. A method of assembling and terminating discrete wires extending from a bundle of wires in an electrical connector of the type comprising an insulating housing having a wire receiving duct extending rearwardly from a location adjacent a contact face and opening at a wire receiving mouth at a rear face; a row of closely spaced contact receiving cavities at the contact face communicating with the duct at the location; and, a row of contacts received in respective cavities, the method comprising the steps of providing a wire holder having a row of apertures at the same pitch as the cavities; loading the discrete wires into respective wire locating apertures to form a subassembly with a row of wires located at the same pitch as the row of cavities; inserting the subassembly through the mouth into and forwardly along the duct to bring the individual wires into alignment with respective contacts and drawing the contacts into terminating engagement with the wires.

16. A method of assembling and terminating discrete wires according to claim 15 in which a portion of the housing is deformed into clamping engagement with the wires at a location between the rear face and the wire holder on termination of the wires.

17. An electrical connector kit comprising an insulating housing having a wire receiving duct extending rearwardly from a location adjacent a contact face and opening at a wire receiving mouth at a rear face; a row of closely spaced contact receiving cavities at the contact face communicating with the wire receiving duct at the location; a row of contacts received in respective cavities; and a wire holder having a row of wire locating apertures at the same pitch as the contacts, the wire holder being insertable into the duct through the mouth when loaded with a series of discrete wires extending from a bundle of wires to bring the discrete wires into alignment with respective contacts.

18. An electrical connector kit according to claim 17 including cable clamping means on the housing between the row of contacts and the rear face deformable into the duct to clamp the wires, the wire holder being insertable when loaded with wires to a location in the duct forward of the cable clamping means.

19. An electrical connector kit according to claim 17 in which the apertures open to a side of the wire holder towards the contacts.

* * * * *